US010730308B2

(12) United States Patent
Miyazawa

(10) Patent No.: US 10,730,308 B2
(45) Date of Patent: Aug. 4, 2020

(54) LIQUID EJECTING APPARATUS

(71) Applicant: SEIKO EPSON CORPORATION, Tokyo (JP)

(72) Inventor: Tomoyuki Miyazawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/358,573

(22) Filed: Mar. 19, 2019

(65) Prior Publication Data

US 2019/0291444 A1 Sep. 26, 2019

(30) Foreign Application Priority Data

Mar. 22, 2018 (JP) ..... 2018-053975

(51) Int. Cl.

*B41J 2/175* (2006.01)
*B41J 29/13* (2006.01)
*B41J 11/00* (2006.01)

(52) U.S. Cl.

CPC ..... *B41J 2/1752* (2013.01); *B41J 2/1753* (2013.01); *B41J 2/17509* (2013.01); *B41J 2/17513* (2013.01); *B41J 2/17523* (2013.01); *B41J 2/17553* (2013.01); *B41J 11/0045* (2013.01); *B41J 29/13* (2013.01)

(58) Field of Classification Search

CPC .. B41J 2/17509; B41J 2/17513; B41J 2/1752; B41J 2/17523; B41J 2/1753; B41J 2/17553; B41J 2/175; B41J 29/02; B41J 29/13; B41J 29/38

See application file for complete search history.

(56) References Cited

U.S. PATENT DOCUMENTS 5,541,631 A * 7/1996 Hashimoto ..... B41J 2/1752 347/86
6,102,506 A 8/2000 Sasai et al.
6,170,940 B1 * 1/2001 Shinada ..... B41J 2/1752 347/86
8,752,943 B2 * 6/2014 Hirano ..... B41J 2/17523 347/86
2007/0229620 A1 * 10/2007 Yano ..... B41J 2/17509 347/86
2013/0182050 A1 7/2013 Aoki et al.
2014/0340453 A1 11/2014 Nagashima et al.
2017/0253050 A1 9/2017 Shimomura

FOREIGN PATENT DOCUMENTS

JP 06-210933 A 8/1994
JP 2013-163375 A 8/2013
JP 2014-240182 A 12/2014
JP 2016-049769 A 4/2016
JP 2016-175279 A 10/2016

* cited by examiner

*Primary Examiner* — Anh T Vo
(74) *Attorney, Agent, or Firm* — Workman Nydegger

(57) ABSTRACT

A liquid ejecting apparatus includes a mounting portion on which a liquid container accommodating a liquid is attachably/detachably mounted and a liquid ejecting head configured to eject the liquid supplied through an outlet port of the liquid container. The mounting portion has a locking portion locking the liquid container and a connection unit connected to the outlet port of the liquid container. The connection unit is provided to be attachable/detachable to/from the mounting portion in a state where the locking portion locks the liquid container.

14 Claims, 12 Drawing Sheets

LIQUID EJECTING APPARATUS

BACKGROUND

1. Technical Field

The present invention relates to a liquid ejecting apparatus such as an ink jet printer.

2. Related Art

As an example of a liquid ejecting apparatus, there is an ink jet printer that performs printing by ejecting ink (liquid) supplied from a liquid container from a recording head (liquid ejecting head) onto a recording medium (for example, refer to JP-A-2014-240182). The liquid container that accommodates ink is mounted on a mounting portion. The mounted liquid container is locked by a locking portion of the mounting portion. An outlet port of the liquid container is connected to a connection unit that includes a liquid feeding pump, and the liquid is supplied to the liquid ejecting head through the outlet port. In such an ink jet printer, the connection unit needs repairing or replacing in some cases when the printer fails.

However, the connection unit is provided in the back side of the mounting portion to face the outlet port of the liquid container. Since replacement of the connection unit connected to the liquid container is not possible in a state where the liquid container is mounted on the mounting portion, it is necessary to release the locking state of the liquid container located at the front and detach the liquid container. The replacement of each mounting portion takes a long time for the attachment/detachment of the liquid container, the disassembly of the printer, and the like.

SUMMARY

An advantage of some aspects of the invention is to provide a liquid ejecting apparatus with excellent serviceability, of which the connection unit can be repaired or replaced in a locking state where the liquid container is mounted.

According to an aspect of the invention, there is provided the liquid ejecting apparatus that includes a mounting portion on which the liquid container accommodating liquid is attachably/detachably mounted and a liquid ejecting head configured to eject a liquid supplied through the outlet port of the liquid container, in which the mounting portion has a locking portion locking the liquid container and a connection unit connected to the outlet port of the liquid container, and the connection unit is provided to be attachable/detachable to/from the mounting portion in a state where the locking portion locks the liquid container.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
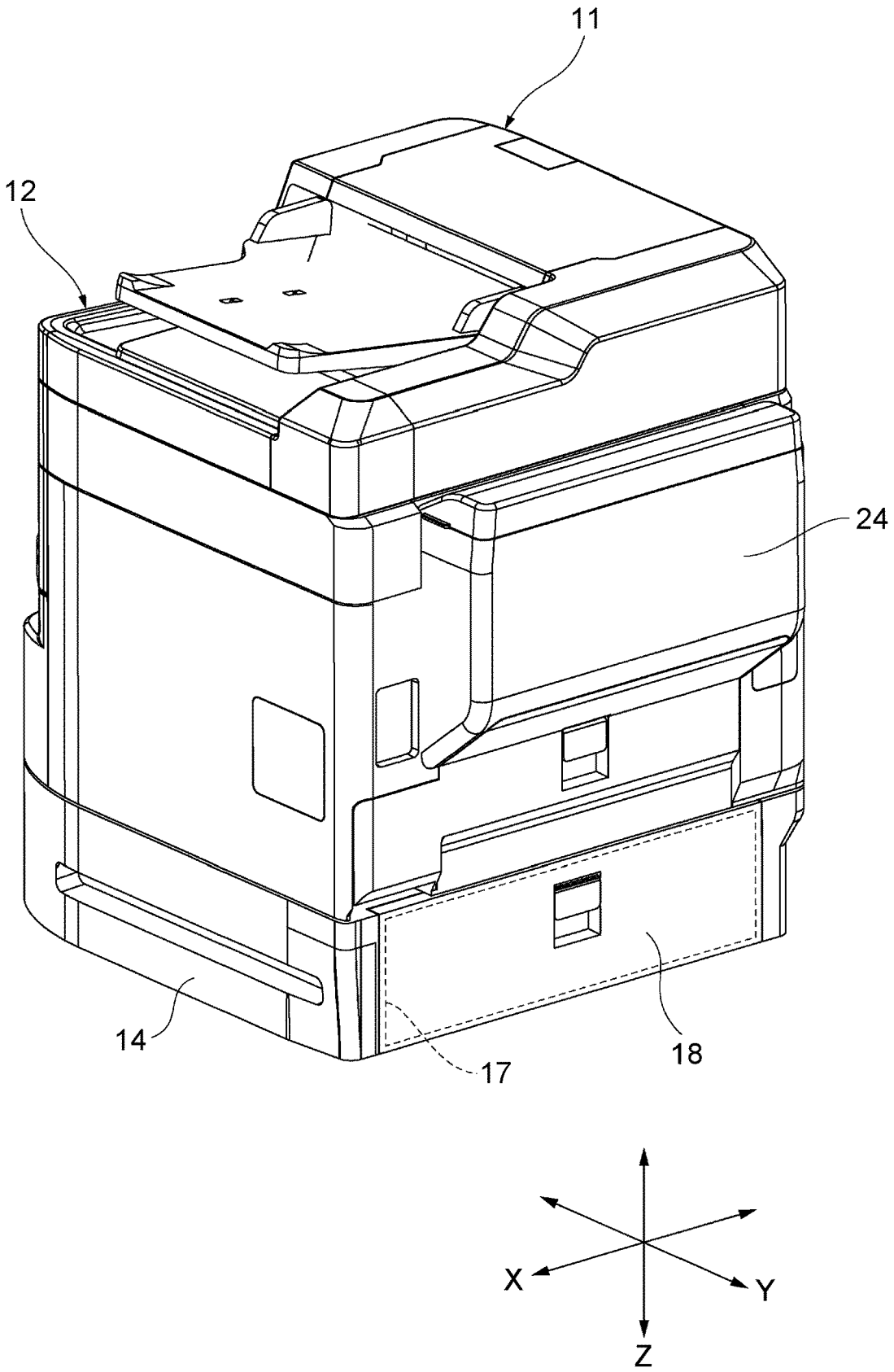
FIG. 1 is a perspective view showing a liquid ejecting apparatus in accordance with an embodiment of the invention.

Hereinafter, an embodiment of the liquid ejecting apparatus will be described with reference to the drawings. The liquid ejecting apparatus, for example, is an ink jet type printer that performs printing by ejecting ink, which is an example of a liquid, onto a medium such as a paper sheet. FIG. 1 is a perspective view showing the liquid ejecting apparatus 11 in accordance with the embodiment. As shown in FIG. 1, the liquid ejecting apparatus 11 includes an exterior body 12 in an approximately rectangular parallelepiped shape. The exterior body 12 is an example of a casing, and an opening 17 for exposing a connection unit 33, to be described later, to the outside is formed. The opening 17 is covered with a cover 18 configured to be openable/closable.

Figure 2:
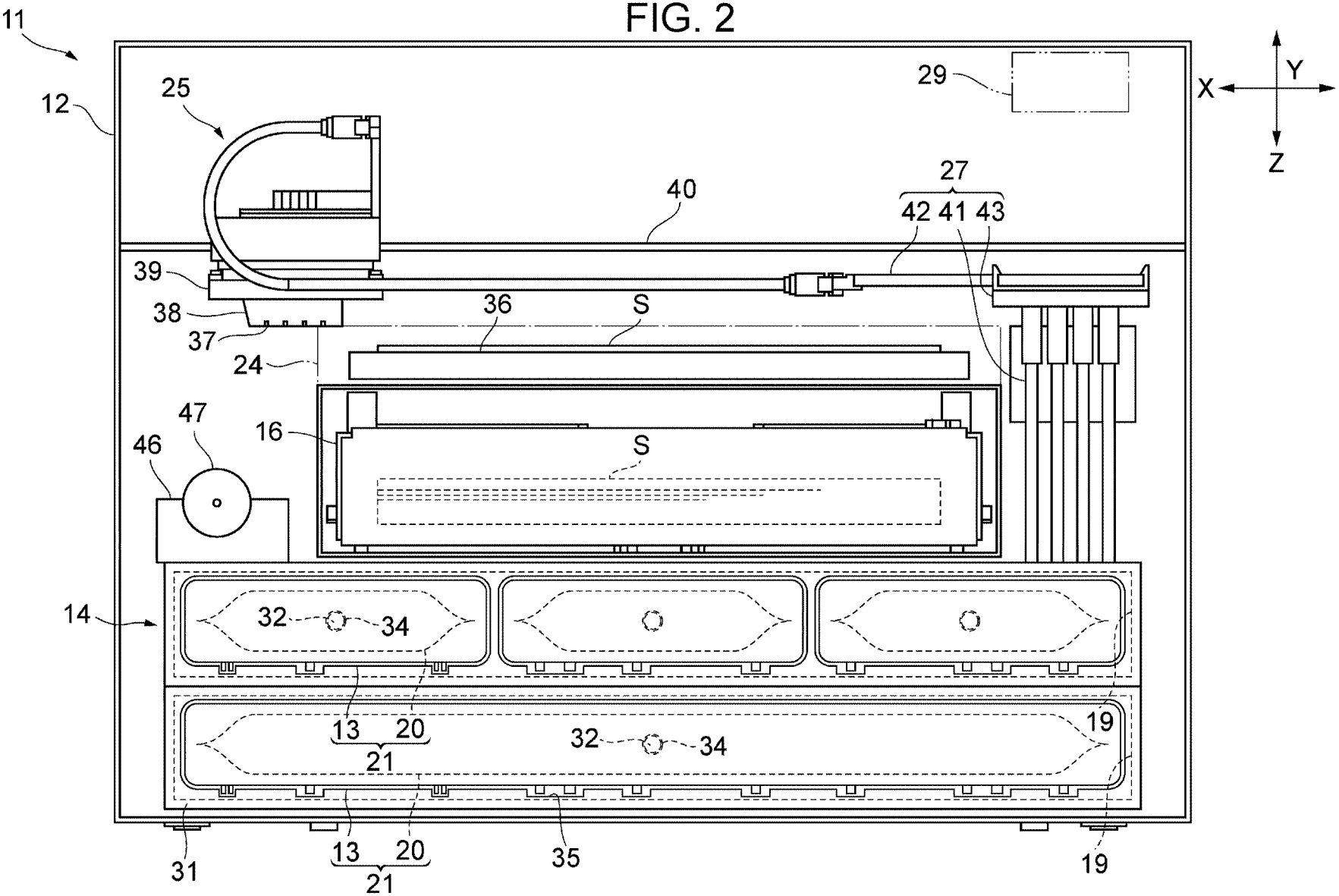
FIG. 2 is a front view schematically showing an internal structure of the liquid ejecting apparatus shown in FIG. 1.

FIG. 2 is a front view schematically showing an internal structure of the exterior body 12. On the exterior body 12, in the order from the bottom side upward, there are provided a mounting portion 14 on which a tray (container) 13 is attachably/detachably mounted, a medium accommodation section (cassette) 16 capable of accommodating a medium S such as a printing paper sheet, and a recording section 25 for ejecting a liquid onto a medium S. A transport path member 24 attached to the recording section 25 picks up and transports the medium S accommodated in the medium accommodation section 16 one by one and disposes the medium S on a medium support section 36.

The recording section 25 includes a liquid ejecting head 38 that ejects a liquid from a nozzle 37 and a carriage 39 that holds the liquid ejecting head 38. A guide shaft 40 extending in the width direction is provided inside the exterior body 12. The operation of the recording section 25 is controlled by a control section 29. The carriage 39 reciprocates in a scanning direction that coincides with the width direction of the liquid ejecting apparatus 11. The liquid ejecting head 38 moves together with the carriage 39 and prints onto the medium S disposed in the medium support section 36 by ejecting a liquid supplied through the mounting portion 14.

At least one liquid container 21 is attachably/detachably mounted on the mounting portion 14. In the example shown in FIG. 2, four liquid accommodation bodies 21 are mounted. The liquid container 21 includes, for example, a tray 13 and a bag-shaped ink pack 20 mounted on the tray 13. Each ink pack 20 is filled with a liquid for printing. An example of a liquid is ink such as black, cyan, magenta, yellow or the like.

The tray 13 is a container that can be attached/detached to/from the mounting portion 14 in a state where the ink pack 20 is mounted. The tray 13 can be used repeatedly by the replacement of the ink pack 20. The liquid container 21 is not limited to the above example and may be an ink cartridge or the like in which the tray 13 and the ink pack 20 are integrally configured.

Each liquid container 21 is connected to the corresponding connection unit 33. More specifically, the connection portion 32 of the connection unit 33 is inserted into the outlet port 34 provided in each ink pack 20. Each connection unit 33 is connected to the liquid ejecting head 38 through the supply flow path 27. Also, the connection unit 33 is connected to the supply mechanism 28 through a pressure supplying flow path to be described later. The supply mechanism 28 includes a pressure varying mechanism 46 and a driving source 47 of the pressure varying mechanism 46. The operation of the supply mechanism 28 will be described later in detail with reference to FIG. 10.

The supply flow path 27 is a flow path for supplying a liquid from the connection unit 33 to the liquid ejecting head 38, and at least one is provided for each color. The supply flow path 27, for example, has an upstream side flow path 41, a downstream side flow path 42, and a connection flow path 43 that connects the upstream side flow path 41 and the downstream side flow path 42. As will be described later in detail with reference to FIG. 9, one end 41E of the upstream side flow path 41 is configured to be attachable/detachable to/from the connection unit 33.

Figure 3:
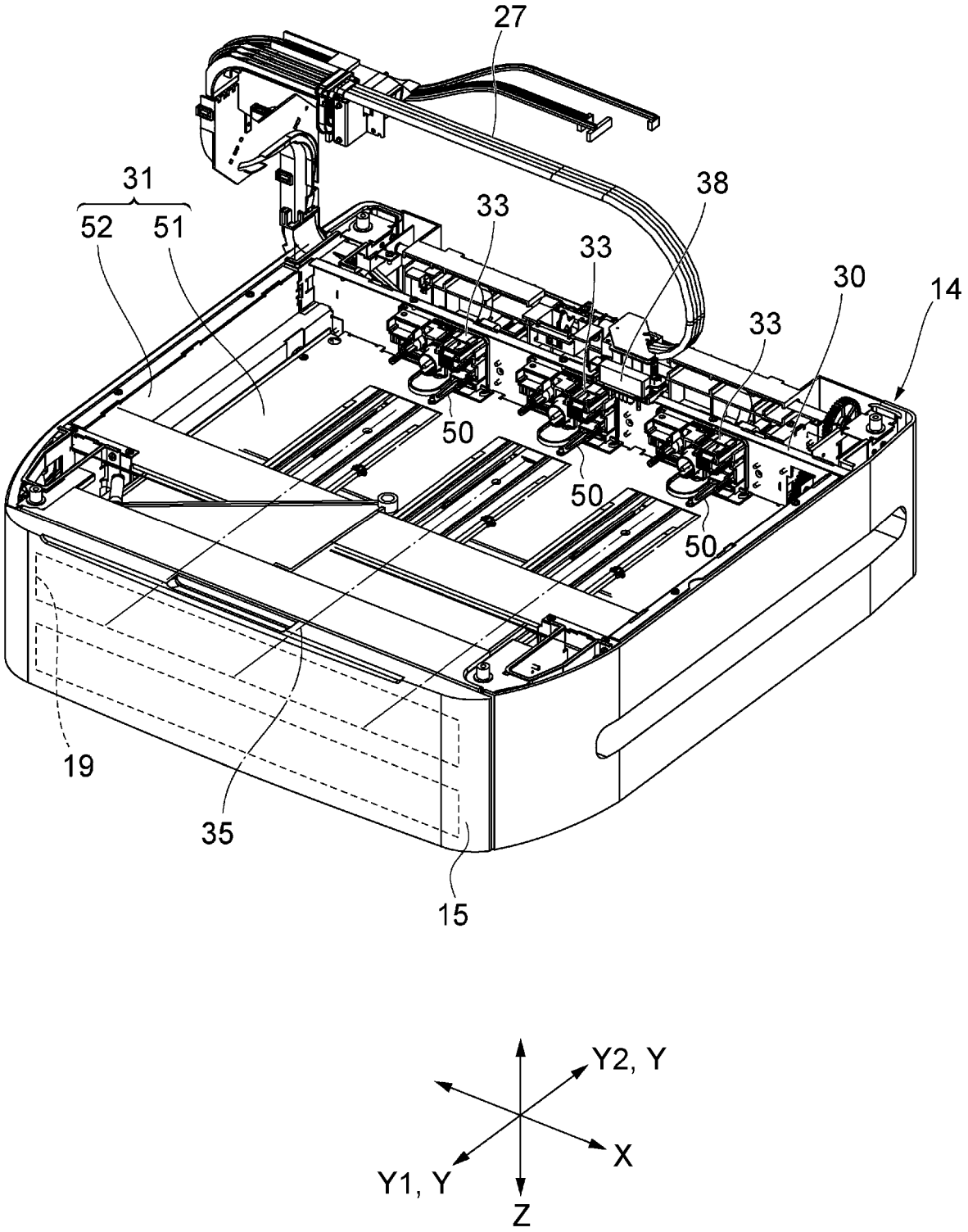
FIG. 3 is a perspective view showing the internal structure of a mounting portion shown in FIG. 2.

FIG. 3 is a perspective view showing the mounting portion 14. The top surface of the mounting portion 14 is covered with a lid (not shown). As shown in FIG. 3, the mounting portion 14 has a bottomed box-shaped frame body 31 that partitions the space for accommodating the liquid container 21. The frame body 31 includes a bottom wall 51 and a surrounding wall 52 erected from the bottom wall 51, for example. An insertion port 19 for replacing the liquid container 21 or the like is formed on one side of the surrounding wall 52. The insertion port 19 is covered with a rotatable lid 15.

A support member 30 formed of a sheet metal is provided on the other side which is the opposite side from the insertion port 19. As shown in FIG. 3, the side denoted by an arrow Y1 is one side, and the side denoted by an arrow Y2 is the other side. The connection unit 33 is supported and fixed in the support member 30.

Also, the mounting portion 14 includes a locking portion 50 configured to lock the liquid container 21. The locking portion 50 is provided in the support member 30 or in the vicinity thereof. The locking portion 50 will be described later in detail with reference to FIG. 5.

A movement path 35 that extends from the insertion port 19 toward the locking portion 50 and the support member 30 is provided in the frame body 31. The movement path 35 guides the movement of the liquid container 21 at the time of attachment/detachment. In the example shown in FIG. 3, the movement path 35 of a recessed line is provided on the bottom wall 51 of the frame body 31. The movement path 35 may be a protruding line or may be disposed on the surrounding wall 52 or the like instead of the bottom wall 51.

The liquid container 21 described above is inserted into the mounting portion 14 through the insertion port 19, slides along the movement path 35 and is connected to the corresponding connection unit 33. In this way, the liquid container 21 is mounted on the mounting portion 14. When the liquid container 21 is mounted on the mounting portion 14, the outlet port 34 that the liquid container 21 has and the connection portion 32 of the connection unit 33 are connected, and the liquid accommodated in the liquid container 21 is ready to be supplied to the liquid ejecting apparatus 11 through the connection portion 32.

In the following description, the exterior body 12 is placed on a horizontal plane. The direction of gravity is denoted by the Z axis, the direction in which the movement path 35 extends is referred to as the depth direction and denoted by Y axis, and the direction in which the connection unit 33 is arranged and which intersects with the depth direction is referred to as the width direction and denoted by X axis. In the example shown in FIG. 3, the X axis, the Y axis, and the Z axis are orthogonal to each other. The X axis, the Y axis, and the Z axis may intersect at an angle other than a right angle (not shown). On the Y axis, the side on which the movement path 35 is positioned as viewed from the locking portion 50 is referred to as a movement path side. In FIG. 3, the movement path side is denoted by a reference symbol Y1 and the opposite side from the movement path side is denoted by a reference symbol Y2.

Figure 4:
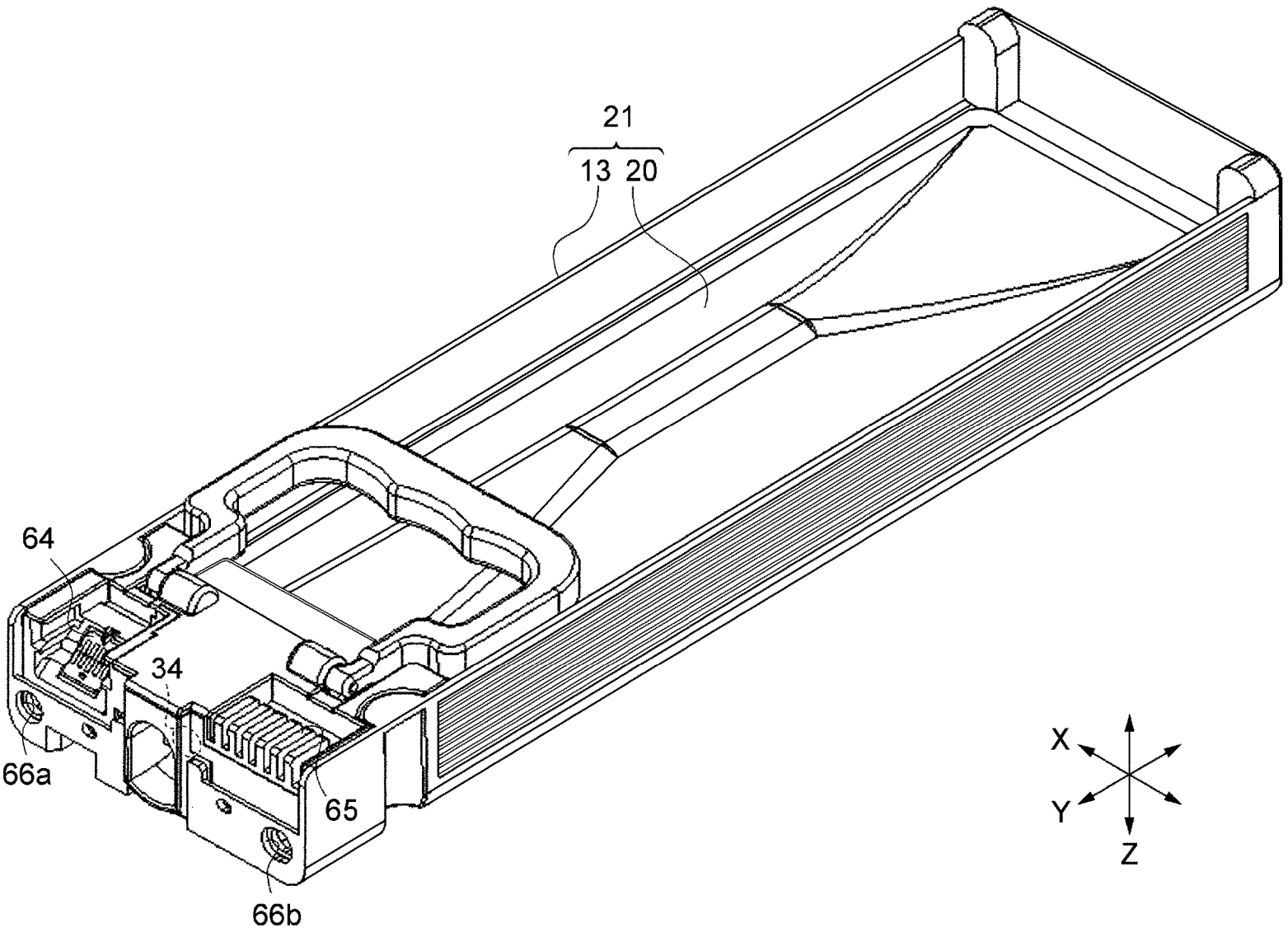
FIG. 4 is a perspective view showing a liquid container shown in FIG. 2.

FIG. 4 is a perspective view showing the liquid container 21. As shown in FIG. 4, the tray 13 of the liquid container 21 is formed in an approximately rectangular parallelepiped shape. The ink pack 20 has a circuit substrate 64 provided on both sides of the outlet port 34 in the width direction and an identification section 65 for preventing an erroneous insertion, and the tray 13 has a pair of positioning holes 66*a* and 66*b* on both sides of the outlet port 34 of the ink pack 20 in the width direction.

The circuit substrate 64 includes a storage section that stores information such as the type and the liquid accommodation capacity of the ink pack 20. The circuit substrate 64 is provided with a connection terminal that is electrically connected to the substrate connection portion 56 of the connection unit 33. The identification section 65 has a protrusion and a recess in a shape to engage with the corresponding block 58 for preventing an erroneous insertion. The positioning holes 66*a* and 66*b* engage with the corresponding regulating portions 59*a* and 59*b* of the connection unit 33.

Figure 5:
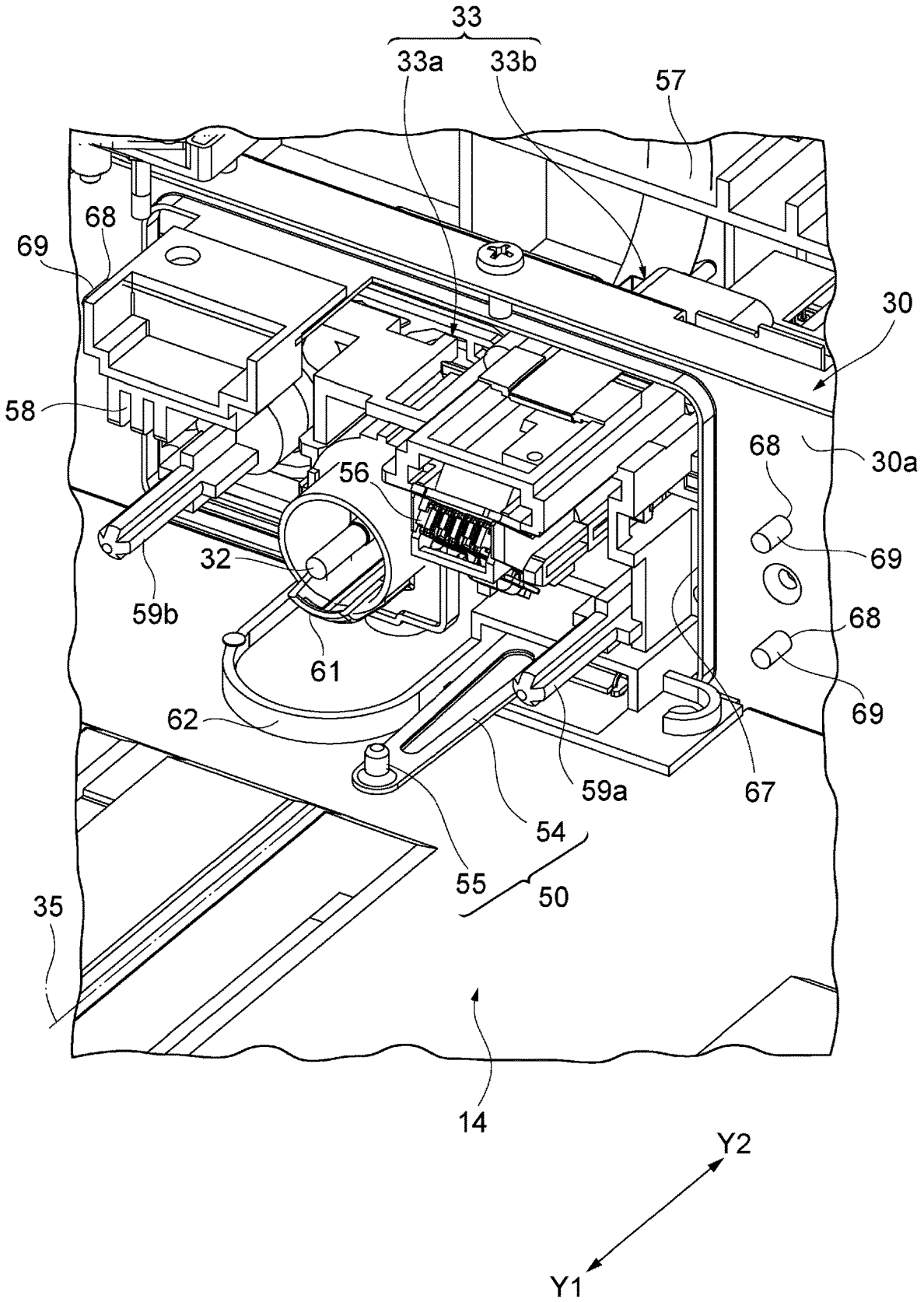
FIG. 5 is an enlarged perspective view showing a connection unit shown in FIG. 3.

FIG. 5 is an enlarged perspective view showing the vicinity of the connection unit 33. As shown in FIG. 5, support member 30 is provided with the block 58 for preventing an erroneous insertion. The block 58 has different protrusions and recesses for each connection unit 33. The block 58 engages with the corresponding identification section 65 of the tray 13 in a state where the locking portion 50 locks the liquid container 21.

The connection unit 33 includes a substrate connection portion 56 provided around the connection portion 32, the erroneous insertion prevention block 58, and a pair of regulating portions 59*a* and 59*b*, in addition to the connection portion 32 described above. An example of the connection portion 32 is a hollow needle which is inserted into the outlet port 34 of the ink pack 20. The substrate connection portion 56 is connected with a control section 29 by an electric line 57 such as a flat cable or the like. In a state where the locking portion 50 locks the liquid container 21, the substrate connection portion 56 is electrically connected to the circuit substrate 64 of the liquid container 21.

A pair of regulating portions 59*a* and 59*b* is disposed such that the connection portion 32 is pinched therebetween and is formed in a bar-shaped protrusion protruding parallel to each other in the depth direction Y. The regulating portion 59*a* and 59*b* are formed to be longer than the connection portion 32 in the depth direction Y, for example. When the liquid container 21 is inserted into the accommodation space to approach the connection unit 33, first, the tip ends of the regulating portions 59*a* and 59*b* engage into the positioning holes 66*a* and 66*b* of the liquid container 21 and regulate the movement of the liquid container 21 in the width direction.

After the regulating portions 59*a* and 59*b* engage with the positioning holes 66*a* and 66*b*, the outlet port 34 of the liquid container 21 is connected to the connection portion 32 when the liquid container 21 further advanced deeper. Further, when the liquid container 21 advances in the mounting direction, the circuit substrate 64 is electrically connected to the substrate connection portion 56, and the control signal of the control section 29 is transmitted to the circuit substrate 64.

When the outlet port 34 of the liquid container 21 is connected to the connection portion 32 in a state where the liquid is ready to be supplied and the circuit substrate 64 is in contact with the substrate connection portion 56 to be electrically connected thereto, the connection of the liquid container 21 to the connection unit 33 is completed. Since the identification section 65 does not engage with the block 58 in a case where the liquid container 21 is mounted at a wrong position, the liquid container 21 cannot advance deeper and an erroneous mounting is prevented.

The locking portion 50 provided in the mounting portion 14 is configured to be separable from the connection unit 33 described above. The locking portion 50 includes an arm 54 protruding on the movement path side Y1 and a lock 55 provided at a tip end of the arm 54. The lock 55 is formed in a protruding shape to engage with a groove provided on the bottom of the tray 13.

In the example shown in FIG. 5, a base end of the arm 54 is mounted on the support member 30 from the movement path side Y1. The locking portion 50 is supported and fixed by the support member 30. On the contrary, the connection unit 33 supported and fixed by the support member 30 is mounted on the support member 30 from the side Y2 opposite to the movement path side Y1.

Figure 6:
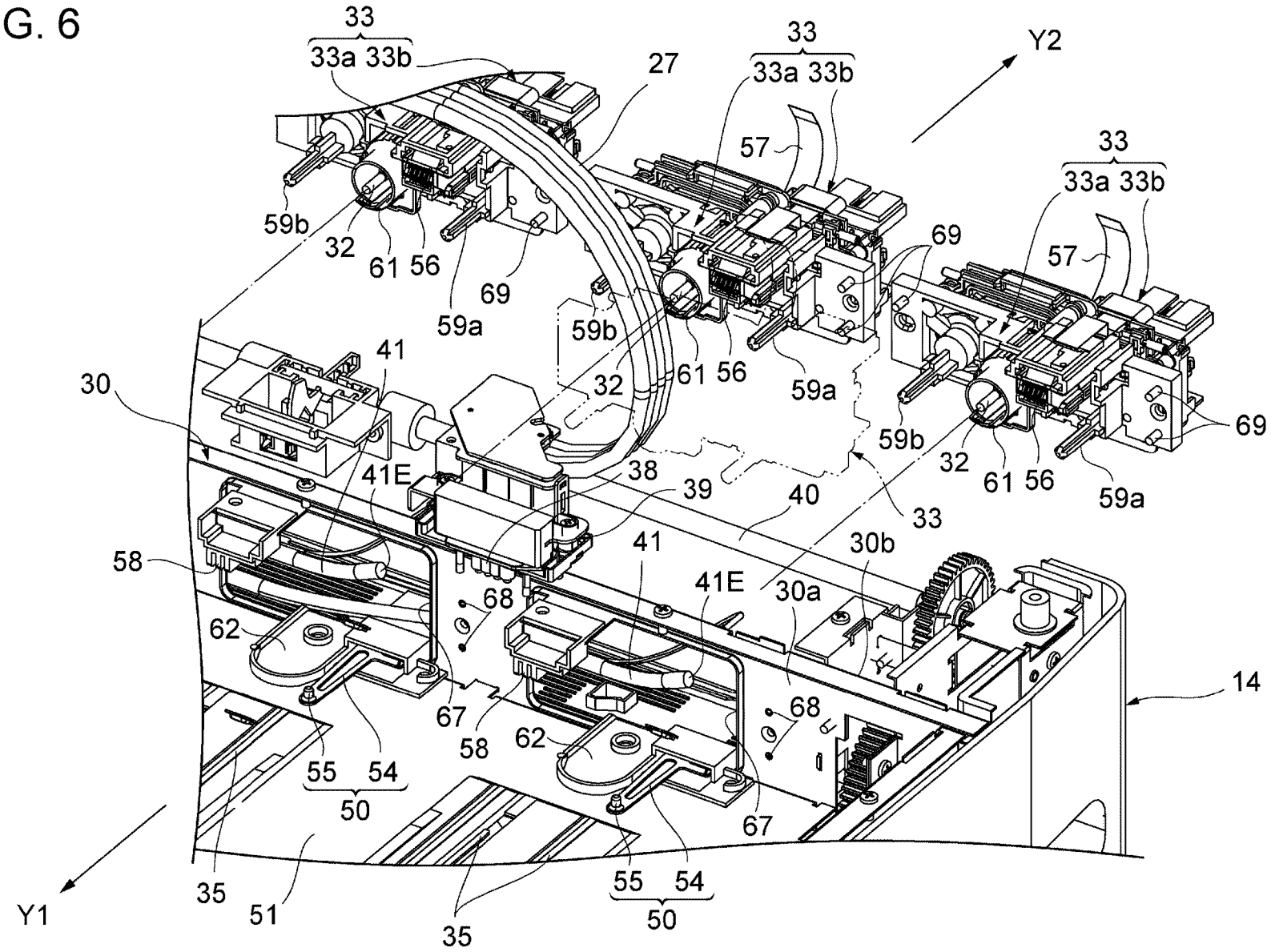
FIG. 6 is a perspective view showing the connection unit detached from a support member.

FIG. 6 is a perspective view showing the connection unit 33 in a detached state from the support member 30. One feature of the present embodiment is that the connection unit 33 can be detached to the side Y2 opposite to the movement path side Y1, as shown in FIG. 6. According to the present embodiment, the connection unit 33 can be replaced without interfering with the liquid container 21 mounted on the movement path side Y1.

The support member 30 has an inner side surface 30*a* facing the movement path 35 and an outer side surface 30*b* opposite to the inner side surface 30*a*. A window 67 running from the outer side surface 30*b* to the inner side surface 30*a* is formed at a position corresponding to the locking portion 50 in the support member 30. The connection unit 33 has a tip end portion 33*a* provided with the connection portion 32 described above or the like and the proximal end portion 33*b* provided with the liquid feeding pump 71 to be described later.

When viewed from the attachment/detachment direction of the connection unit 33, the window 67 of the support member 30 is formed to be larger than the tip end portion 33*a* of the connection unit 33 and smaller than the proximal end portion 33*b*. In the example shown in FIG. 6, the attachment/detachment direction of the connection unit 33 coincides with the depth direction Y described above. In a state where the connection unit 33 is mounted on the support member 30, as shown in FIG. 5, the tip end portion 33*a* is inserted into the window 67 and protrudes from the inner side surface 30*a* of the support member 30. The connection portion 32 or the like provided at the tip end portion 33*a* is disposed in the inner space of the mounting portion 14.

The proximal end portion 33*b* abuts against the outer side surface 30*b* of the support member 30 and is fixed by a fastening screw or the like. A positioning through hole 68 may be formed in the support member 30 and a positioning pin 69 inserted into the through hole 68 may be provided at the proximal end portion 33*b*.

Figure 7:
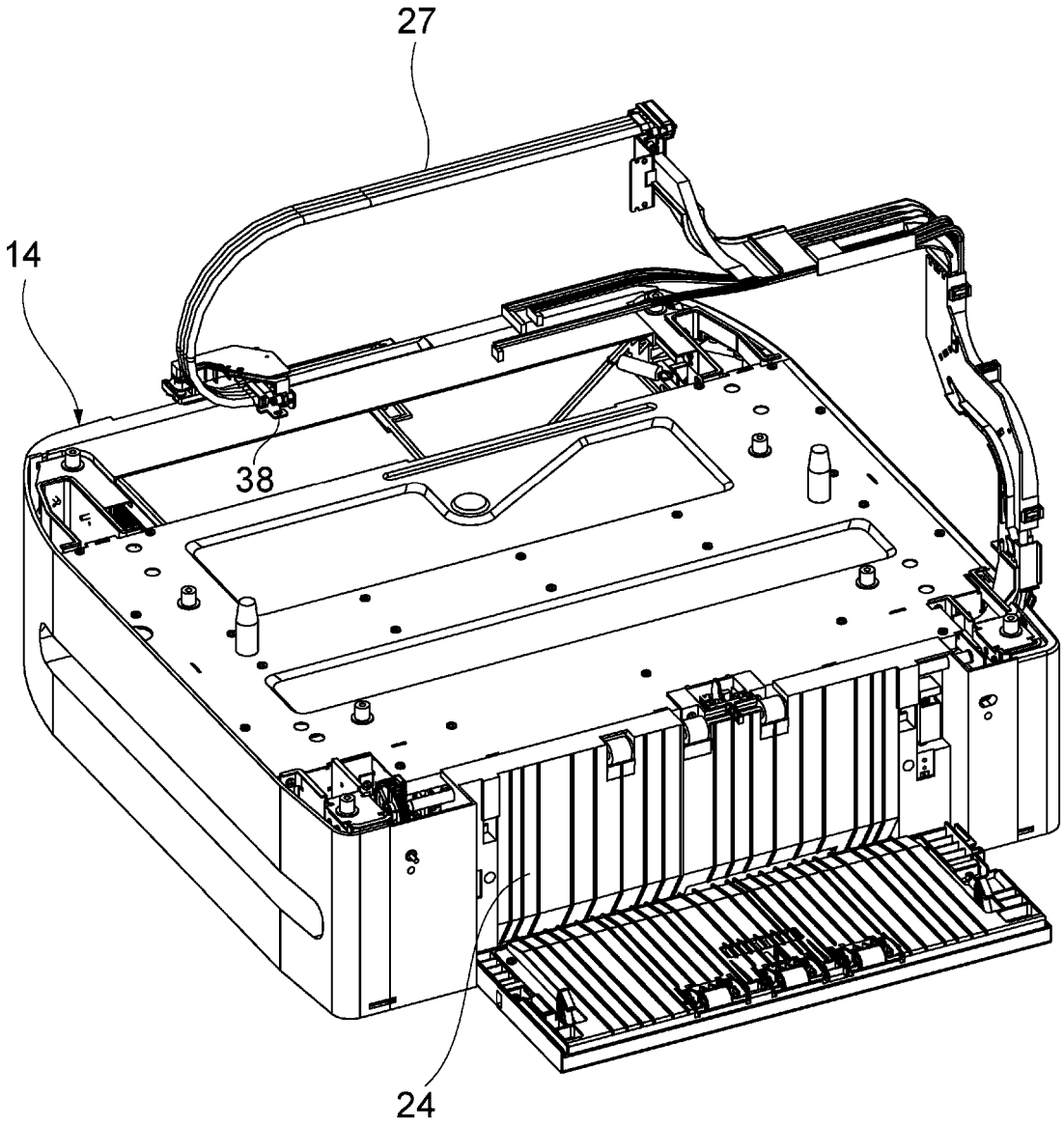
FIG. 7 is a perspective view of a modification example in which a part of a transport path member covers the connection unit.
Figure 8:
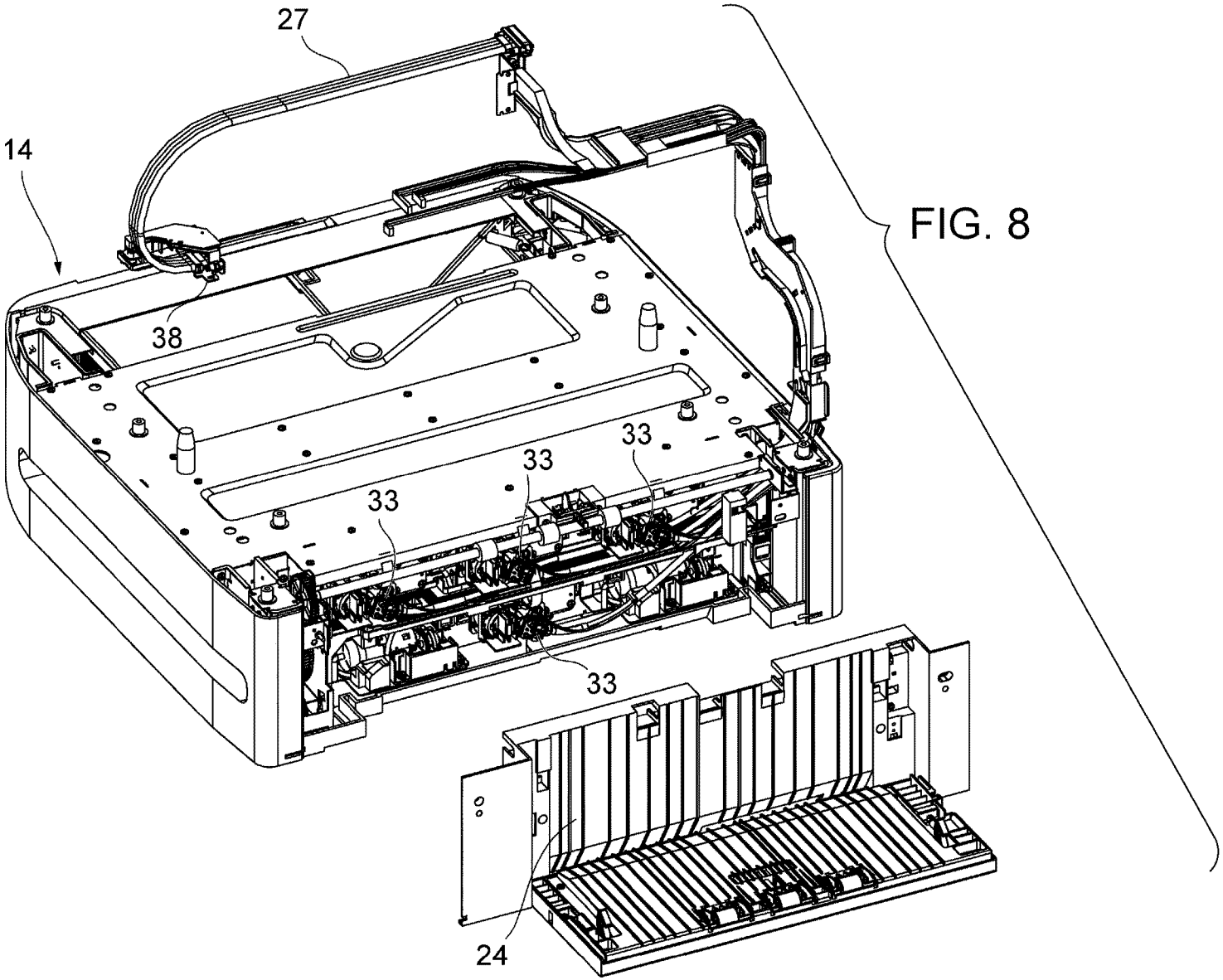
FIG. 8 is a perspective view showing the mounting portion in a state where the transport path member shown in FIG. 7 is detached.

When the connection unit 33 is attached/detached to/from the outer side surface 30*b* of the support member 30, the cover 18 shown in FIG. 1 is opened so that the connection unit 33 can be exposed to the outside from the opening 17 formed in the exterior body 12. The method of exposing the connection unit 33 to the outside is not limited to the example shown in FIG. 1. FIG. 7 is a modification example in which a part of the transport path member 24 for transporting the medium S, not the cover 18, covers the connection unit 33. In the modification example shown in FIG. 7, the transport path member 24 is detached and the connection unit 33 can be exposed to the outside as shown in FIG. 8.

Also, when the connection unit 33 is attached/detached, a liquid may drip from the connection portion 32 in some cases. Therefore, a liquid receiving portion 62 or the like may be provided for receiving the liquid that drips on the attachment/detachment path of the connection unit 33. In the example shown in FIG. 6, the liquid receiving portion 61 is provided in the connection unit 33 and the liquid receiving portion 62 is provided in the vicinity of the support member 30. The liquid receiving portion 62 is formed in a dish shape and disposed on the attachment/detachment path of the connection portion 32.

Figure 9:
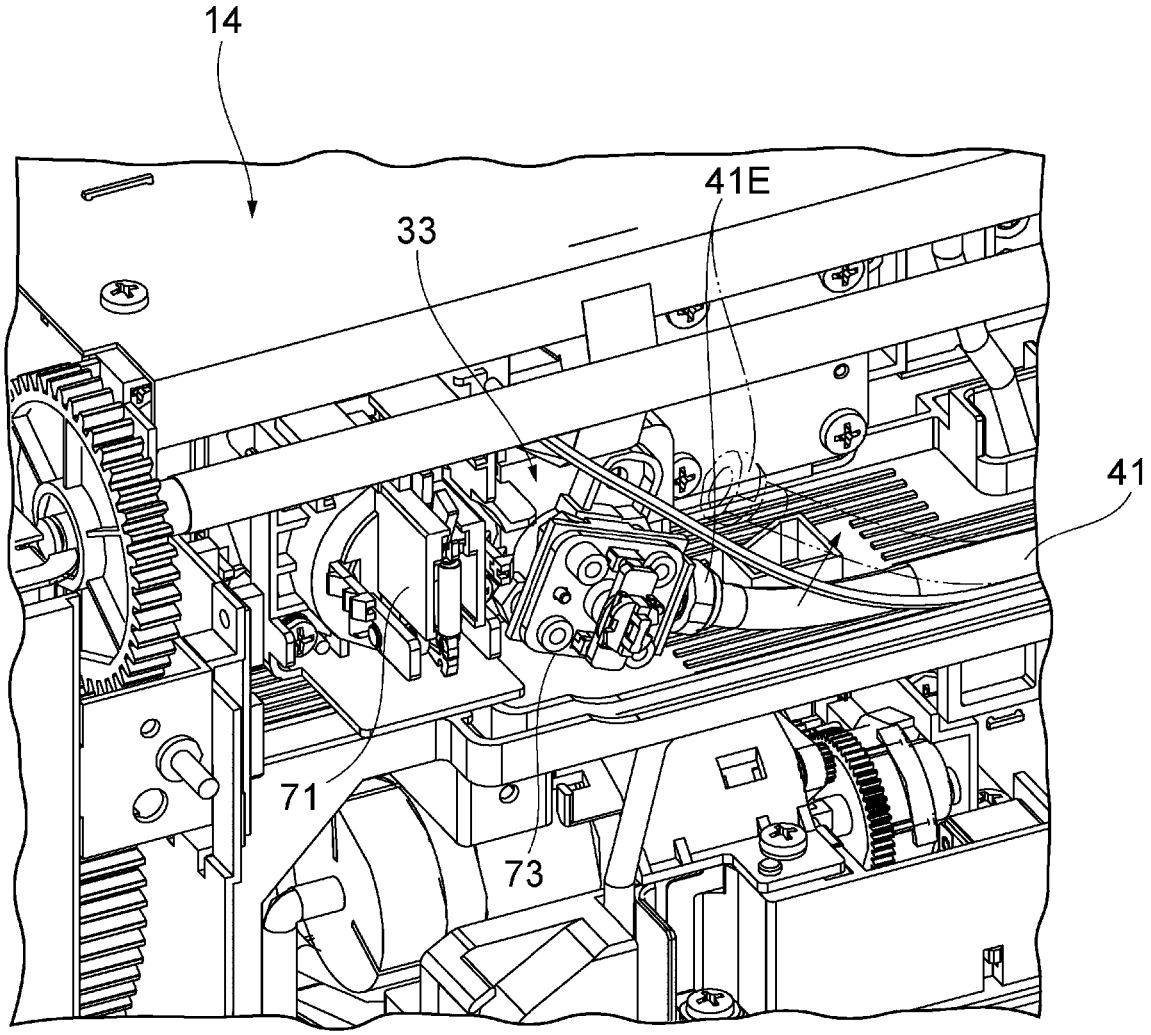
FIG. 9 is a perspective view showing the connection unit in which one end of a supply flow path is configured to be attachable/detachable.

FIG. 9 is a perspective view showing one end 41E of the upstream side flow path 41 constituting the supply flow path 27. As shown in FIG. 9, one feature of this embodiment is that one end 41E of the supply flow path 27 (upstream side flow path 41) is mounted on the connection unit 33 not from the movement path side Y1 but from the side Y2 opposite thereto. Therefore, it is possible to detach the supply flow path 27 from the connection unit 33 by working from the side Y2 opposite to the movement path side Y1.

Since the connection unit 33 can freely move without being limited by the length of the supply flow path 27 if one end 41E is detached from the connection unit 33, the repair or the replacement of the connection unit can be executed in a short period of time. The casing 12 may include a clip or the like capable of temporarily fastening the detached supply flow path 27. If there is a clip or the like for fixing the detached supply flow path 27 to a predetermined portion (for example, liquid receiving portion 62) of the casing 12, a liquid dripping from one end 41E can be prevented from adhering to the sleeves or the like of the worker during the replacement work.

Figure 10:
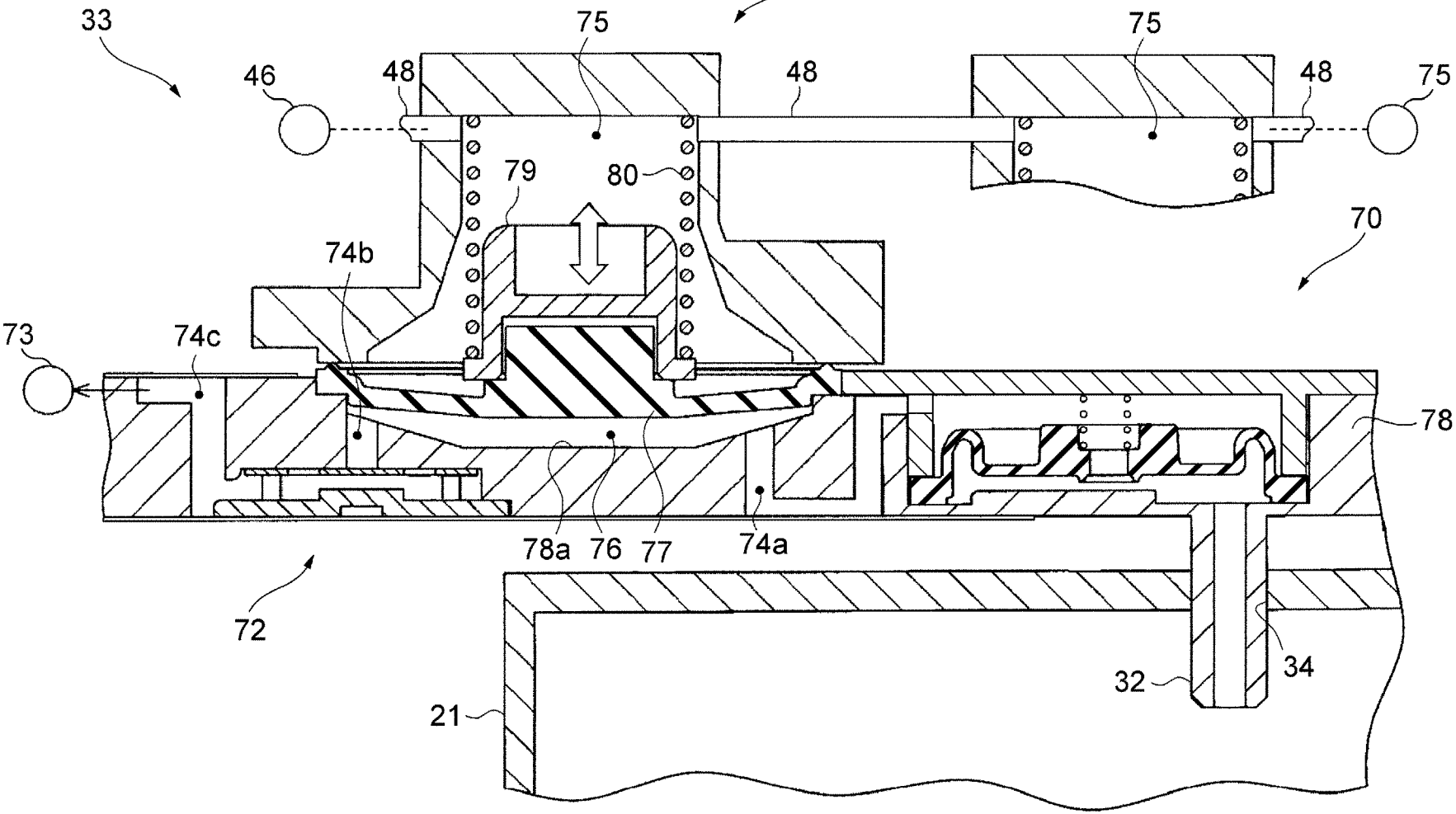
FIG. 10 is a sectional view schematically showing an internal structure of the connection unit shown in FIG. 5.

FIG. 10 is a sectional view schematically showing the internal structure of the connection unit 33. The connection unit 33 includes, in the order from the upstream side to the downstream side, a suction side one-way valve 70, a liquid feeding pump 71, an ejection side one-way valve 72 and a buffer 73. The liquid feeding pump 71 is an example of liquid feeding unit and is a diaphragm type pump that performs a suction operation for sucking the liquid accommodated in the liquid container 21 and an ejection operation for ejecting the sucked liquid toward the liquid ejecting head 38 side.

The suction side one-way valve 70 is connected to the outlet port 34 of the ink pack 20 of the liquid container 21 through the connection portion 32 described above. The buffer 73 is connected to one end 41E of the upstream side flow path 41 described above. The suction side one-way valve 70 and the pump 71 communicate with each other through the first flow path 74*a*. The liquid feeding pump 71 and the ejection side one-way valve 72 communicate with each other through the second flow path 74*b*. Further, the ejection side one-way valve 72 and the buffer 73 communicate with each other through the third flow path 74*c*, and the buffer 73 and the upstream side flow path 41 communicate with each other through the fourth flow path 74*d*.

As shown in FIG. 10, the liquid feeding pump 71 includes a pressure regulation chamber 75 connected to the pressure supplying flow path 48, a liquid feeding chamber 76 and a diaphragm 77 that partitions the pressure regulation chamber 75 and the liquid feeding chamber 76. The connection unit 33 has a flow path formation member 78 in which liquid feeding recessed portion 78*a* is formed. The liquid feeding chamber 76 is surrounded by the liquid feeding recessed portion 78*a* and the diaphragm 77. The downstream end of the first flow path 74*a* and the upstream end of the second flow path 74*b* are connected with each other.

The pressure regulation chamber 75 of the liquid feeding pump 71 mounted on each connection unit 33 is connected in series by the pressure supplying flow path 48. One of the plurality of connection units 33 is connected to a pressure varying mechanism 46 shown in FIG. 2. The remaining connection unit 33 is connected to the pressure varying mechanism 46 through the pressure supplying flow path 48. The pressure supplying flow path 48 is configured to be attachable/detachable to/from the connection unit 33. Therefore, when the connection unit 33 is detached from the support member 30, each connection unit 33 can be detached individually.

When the supply mechanism 28 is driven, each of the pressure regulation chambers 75 has a negative pressure. In the pressure regulation chamber 75, a spring seat 79 which is displaced together with the diaphragm 77 and a first coil spring 80 which urges the diaphragm 77 toward the liquid feeding chamber 76 are accommodated. When the negative pressure is generated inside the pressure regulation chamber 75 in accordance with the activation of the supply mechanism 28, the liquid feeding pump 71 performs the suction operation by the diaphragm 77 resisting the urging force of the first coil spring 80 to be displaced in favor of expanding the volume of the liquid feeding chamber 76. On the other hand, when the supply mechanism 28 opens up the pressure regulation chamber 75 to the air after the suction operation, the liquid feeding pump 71 performs the ejection operation by the diaphragm 77 being displaced in favor of contracting the volume of liquid feeding chamber 76 by the urging force of the first coil spring 80.

Figure 11:
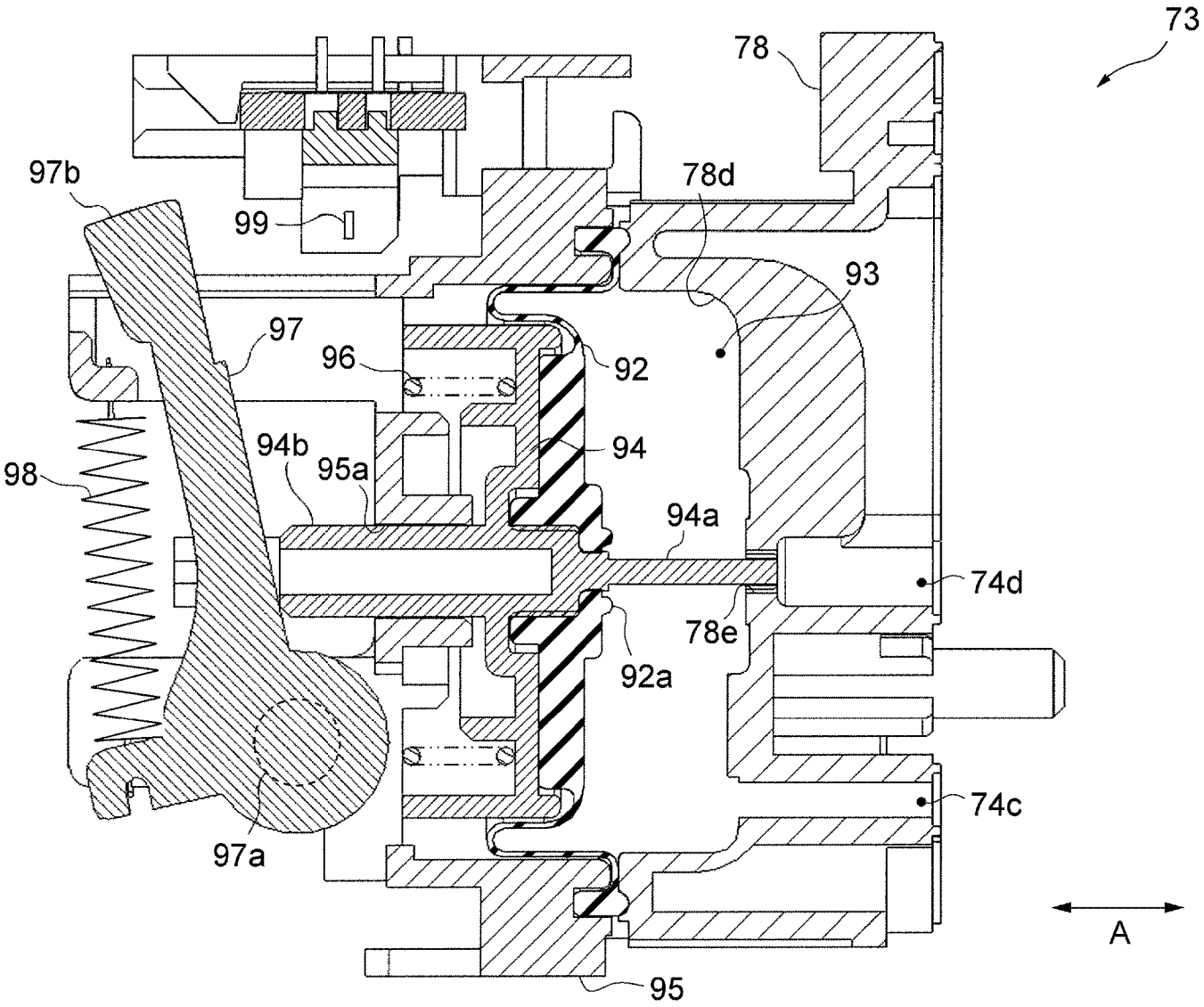
FIG. 11 is a sectional view schematically showing the internal structure of a buffer shown in FIG. 10.

FIG. 11 is a sectional view schematically showing the internal structure of the buffer 73. As shown in FIG. 11, the buffer 73 has a liquid chamber 93 surrounded by a recessed portion 78*d* formed in the flow path formation member 78 and a flexible member 92. The liquid chamber 93 is connected to a downstream end of the third flow path 74*c* and an upstream end of the fourth flow path 74*d*.

The buffer 73 includes a displacement member 94 connected to the flexible member 92 and displaced together with the flexible member 92, a fixing member 95 for fixing the flexible member 92 by abutting against an outer edge portion of the flexible member 92, and a first urging member 96 such as a coil spring disposed between the displacement member 94 and the fixing member 95. The displacement member 94 is provided on the outer surface opposite to the inner surface constituting the liquid chamber 93 of the flexible member 92. The first urging member 96 urges the displacement member 94 so as to urge the flexible member 92 into reducing the volume of the liquid chamber 93.

The displacement member 94 includes a first guided portion 94*a* protruding into the liquid chamber 93 in the displacement direction denoted by the arrow A in FIG. 11 and a second guided portion 94*b* protruding to the opposite side from the liquid chamber 93. Further, a first guide portion 78*e* for guiding the first guided portion 94*a* in the displacement direction A of the flexible member 92 is formed in the flow path formation member 78. Further, a second guide portion 95*a* for guiding the second guided portion 94*b* in the displacement direction A is formed in the fixing member 95. The connection unit 33 has guide portions 78*e* and 95*a* and the guided portions 94*a* and 94*b*, and the guided portions 94*a* and 94*b* are connected to the flexible member 92 and displaced together with the flexible member 92.

The first guided portion 94*a* is provided in a shaft shape in a manner of protruding toward the liquid chamber 93 from an approximately central position of the flexible member 92 in an approximately disc shape. Also, the first guide portion 78*e* is formed in a hole shape in the recessed portion 78*d* and is configured so that the first guided portion 94*a* is inserted thereinto. For example, it is preferable that the first guided portion 94*a* be a rod-like columnar body having at least one recessed line that extends in the displacement direction A, and the gap between the first guide portion 78*e* in a round hole shape and the first guided portion 94*a* constitutes a part of the fourth flow path 74*d*. Further, the flexible member 92 has a closing portion 92*a* protruding annularly at a position surrounding the first guided portion 94*a*.

It is preferable that the first guided portion 94*a* be positioned at a position where the flexible member 92 is farthest away from the first guide portion 78*e* and that the first guided portion 94*a* be long enough to engage with the first guide portion 78*e* when the volume of the liquid chamber 93 is at the maximum. Further, as shown in FIG. 11, it is preferable that the second guided portion 94*b* be positioned at a position where the flexible member 92 is farthest away from the second guide portion 95*a* and that the second guided portion 94*b* be long enough to engage with the second guide portion 95*a* when the volume of the liquid chamber 93 is at the minimum. With such a configuration, it is possible to reduce the possibility for the guided portions 94*a* and 94*b* to be disengaged from the guide portions 78*e* and 95*a*.

The closing portion 92*a* closes the supply flow path 27 by the flexible member 92 being displaced to reduce the volume of the liquid chamber 93 so as to abut against the recessed portion 78*d* which is the wall of the liquid chamber 93. That is, the flexible member 92 stops the communication between the liquid chamber 93 and the fourth flow path 74*d* by surrounding the first guide portion 78*e* with the closing portion 92*a*.

Further the connection unit 33 includes a lever section 97 provided to be rotatable around a shaft 97*a*, a second urge member 98 that urges the lever section 97, and a displacement detection section 99 that detects the displacement of the flexible member 92 by detecting the detection receiving portion 97*b* included in the lever section 97. An example of the second urge member 98 is a tension spring, and an example of the displacement detection section 99 is an optical sensor having a light emission section and a light reception section.

The lever section 97 pivots against the urging force of the second urge member 98 by the pressure on the second guided portion 94*b* and assumes a non-detection posture in which the detection receiving portion 97*b* is not detected by the displacement detection section 99. Then as shown in FIG. 11, with no pressure on the second guided portion 94*b*, the lever section 97 assumes a detection posture in which the detection receiving portion 97*b* is detected by the displacement detection section 99.

The liquid feeding pump 71 alternately performs the suction operation and the ejection operation in succession. Since the liquid is supplied to the liquid chamber 93 through the third flow path 74*c* when the liquid feeding pump 71 performs the ejection operation, by the increased pressure of the liquid, the flexible member 92 resists the urging force of the first urging member 96 to be displaced to the fixing member 95 side. That is, the flexible member 92 is displaced so as to increase the volume of the liquid chamber 93, and the displacement member 94 pressures the lever section 97 to a non-detection posture.

When the liquid is ejected from the liquid ejecting head 38 and consumed, the liquid inside the liquid chamber 93 flows out to the fourth flow path 74*d*. Since the supply flow path 27 has the chamber 93 of which the volume is variable, the liquid can be supplied to the liquid ejecting head 38 even while the liquid feeding pump 71 performs the suction operation. Then, when the liquid feeding pump 71 performs the ejection operation, the liquid as much as the volume that flows out of the liquid chamber 93 is supplied to the liquid chamber 93 from the liquid feeding pump 71, and the liquid chamber 93 remains in communication with the fourth flow path 74*d*.

When the volume of the liquid accommodated in the liquid container 21 reaches an end state in which the remaining volume of the liquid is insufficient for print execution, the liquid supply from the liquid container 21 stops. Then, the volume of the liquid chamber 93 shrinks by the volume of liquid that flows out to the fourth flow path 74*d*. Then, as described above, the flexible member 92 is displaced to approach the recessed portion 78*d* so that the volume of the liquid chamber 93 shrinks. Also, at this time, the lever section 97 assumes the detection posture, and the displacement detection section 99 outputs the detection signal that the detection receiving portion 97*b* is detected to the control section 29.

In a case where a suction cleaning of the liquid ejecting head 38 is executed, the liquid inside the liquid chamber 93 flows out to the fourth flow path 74*d* when the liquid is sucked from the liquid ejecting head 38. Then, the liquid as much as the volume of the liquid that flows out of the liquid chamber 93 is supplied from the liquid feeding pump 71 to the liquid chamber 93. When the diaphragm 77 of the liquid feeding pump 71 abuts against the liquid feeding recessed portion 78*a*, and the liquid is not supplied from the liquid feeding pump 71, the volume of the liquid chamber 93 shrinks by as much as the liquid that flows out to the fourth flow path 74*d*. That is, when the liquid is sucked from the liquid ejecting head 38 in a state where the liquid feeding pump 71 is not running, the flexible member 92 is displaced by the reduction of the liquid inside the liquid chamber 93 such that the volume of the liquid chamber 93 shrinks so as to close the supply flow path 27.

Further, when the liquid is sucked from the liquid ejecting head 38 in a state where the supply flow path 27 is closed by the flexible member 92, the negative pressure in the supply flow path 27 on the downstream side of the fourth flow path 74*d* and the liquid ejecting head 38 increases. Since the ejection side one-way valve 72 is closed when the liquid feeding pump 71 performs the suction operation in this state, the buffer 73 keeps closing the supply flow path 27.

When the liquid is fed from the liquid feeding pump 71 by the liquid feeding pump 71 performing the ejection operation after the suction operation, the liquid flows into the liquid chamber 93 of the buffer 73 through the third flow path 74*c*, and the flexible member 92 is displaced to increase the volume of the liquid chamber 93. That is, the flexible member 92 opens the supply flow path 27 when the liquid feeding pump 71 is driven in a state where the liquid is sucked from the liquid ejecting head 38 and closes the supply flow path 27.

As a result, the closing of the supply flow path 27 is released, and the air bubbles remaining inside the liquid ejecting head 38 and the liquid having increased viscosity are discharged forcefully through the nozzle 37 together with the liquid fed from the liquid feeding pump 71. Since the liquid ejecting apparatus 11 in accordance with the embodiment includes the buffer 73, the so-called chalk cleaning can be executed.

Figure 12:
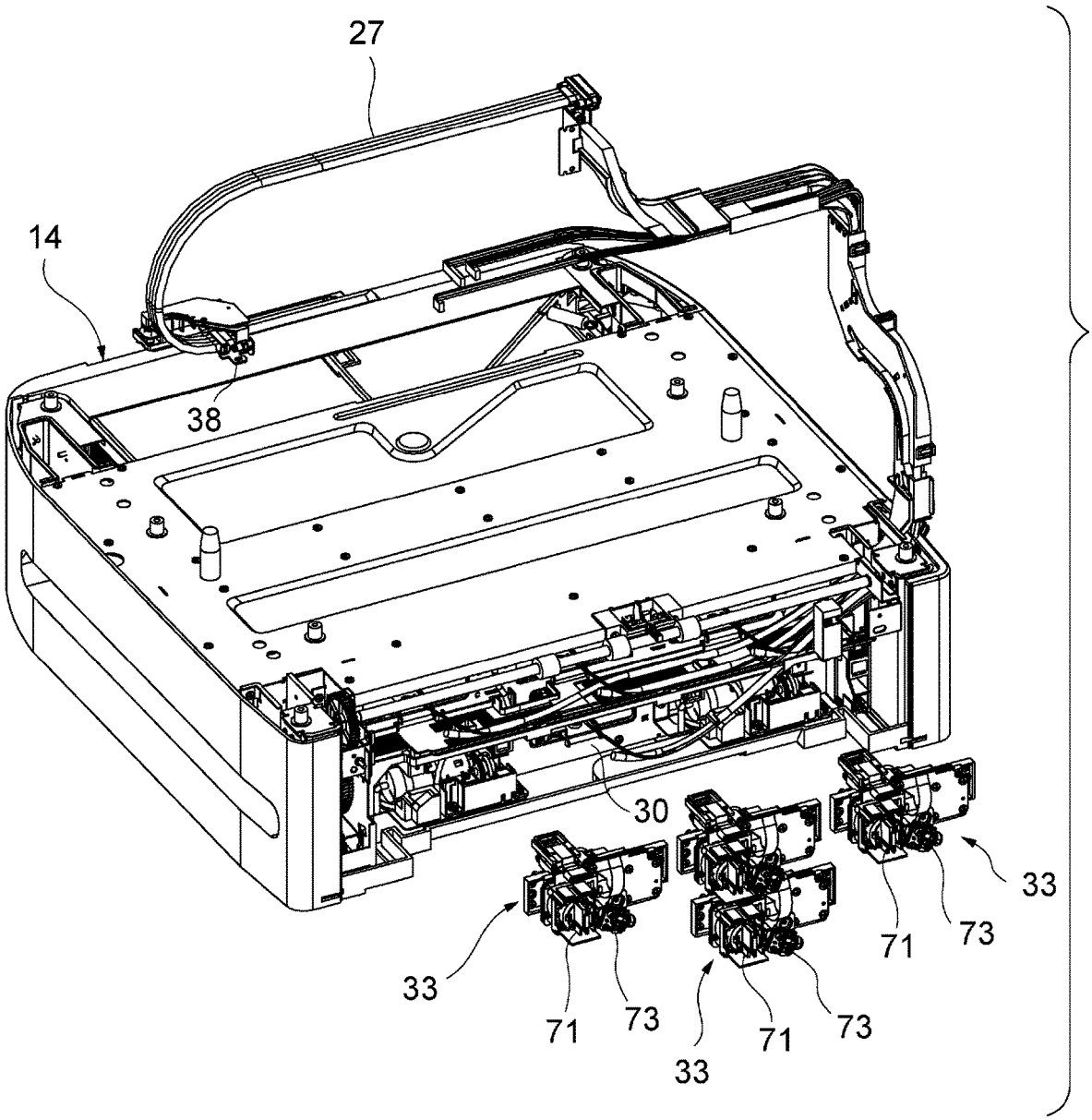
FIG. 12 is a perspective view showing a state where a liquid feeding pump shown in FIG. 10 is detached together with each connection unit.

FIG. 12 is a perspective view showing the state in which the liquid feeding pump 71 and the buffer 73 described above are detached together with each connection unit 33. In the embodiment, since the connection unit 33 on which the liquid feeding pump 71 is mounted can be detached from the side Y2 opposite to the movement path side Y1, the liquid feeding pump 71 described above can be easily repaired. Also, as shown in FIG. 9, since the supply flow path 27 can be detached from the side Y2 which is opposite to the movement path side Y1, the liquid feeding pump 71 can be replaced together with each connection unit 33.

The embodiment described above is to facilitate understanding of the invention and is not intended to limit the interpretation of the invention. Each element included in the embodiment along with the disposition, the materials, the conditions, the shapes, the sizes and the like thereof are not limited to those presented as examples and can be modified as deemed appropriate. Also, it is possible to partially replace or combine the configurations shown in the different embodiments.

When the liquid ejecting apparatus 11 is an ink jet printer, it is necessary to minimize the time during which printing cannot be performed. In particular, if the printer used in an office or the like fails to work by any chance, the serviceman needs to be able to complete the repair in a short time at the visiting destination. According to the present embodiment, it is possible to provide a liquid ejecting apparatus 11 with the excellent serviceability of which the connection unit 33 can be repaired or replaced in a short time.

In the following, the technical ideas grasped from the embodiment and modification examples described above and the operational effects thereof will be described.

Idea 1

The liquid ejecting apparatus includes a mounting portion on which a liquid container that can accommodate a liquid is attachably/detachably mounted and a liquid ejecting head configured to eject the liquid supplied through an outlet port of the liquid container onto a medium, the mounting portion has a locking portion locking the liquid container and a connection unit connected to the outlet port of the liquid container, and the connection unit is attachably/detachably provided to the mounting portion in a state where the locking portion locks the liquid container.

With this configuration, since the connection unit can be attached/detached in a state where the liquid container is mounted on the mounting portion, the repair or the replacement of the connection unit can be executed in a short time.

Idea 2

In the liquid ejecting apparatus according to Idea 1, it is preferable that the mounting portion have a movement path that extends toward a locking portion and that the connection unit be configured to be attachable/detachable to/from the locking portion from the side opposite to the movement path side on which the movement path is provided in a state where the locking portion locks the liquid container.

With this configuration, since the connection unit can be attached/detached from the side opposite to the movement path side, the repair or the replacement of the connection unit can be executed in a short time.

Idea 3

In the liquid ejecting apparatus according to Idea 1 or 2, it is preferable that the mounting portion have a movement path that extends toward the locking portion and a support member supporting and fixing the locking portion and the connection unit, that the locking portion be supported and fixed on the movement path side of the support member, and that the connection unit be supported and fixed on the side opposite to the movement path side of the support member.

With this configuration, the connection unit can be attached/detached by the work from the side opposite to the movement path side alone. Since the connection unit can be attached/detached without interference with the liquid container disposed on the movement path side, the repair or the replacement of the connection unit can be executed in a short time.

Idea 4

It is preferable that the liquid ejecting apparatus according to any one of the Ideas 1 to 3 further include a supply flow path which communicates with the connection unit and the liquid ejecting head, that the mounting portion has a movement path that extends toward the locking portion, and that one end of the supply flow path be attachable/detachable to/from the connection unit from the side opposite to the movement path side.

With this configuration, the supply flow path can be attached/detached from the work on the side opposite to the movement path side alone. Since the supply flow path can be attached/detached without interference with the liquid container disposed on the movement path side, the repair or the replacement of the connection unit connected to the supply flow path can be executed in a short time.

Idea 5

In the liquid ejecting apparatus according to any one of the Ideas 1 to 4, it is preferable that the mounting portion have a movement path that extends toward the locking portion and that the connection unit have a regulating portion that regulates the movement of the liquid container in the direction that intersects with the direction in which the movement path extends.

With this configuration, the positioning of the liquid container with respect to the connection unit is easy when the replaced connection unit is attached, and the repair or the replacement of the connection unit can be executed in a short time.

Idea 6

In the liquid ejecting apparatus according to any one of Ideas 1 to 5, it is preferable that the connection unit have a substrate connection portion that can be electrically connected to the circuit substrate provided in the liquid container.

With this configuration, since the circuit substrate provided in the liquid container is not electrically connected in a state where the connection unit is detached, an erroneous operation of the liquid ejecting apparatus can be prevented.

Idea 7

In the liquid ejecting apparatus according to any one of the Ideas 1 to 6, it is preferable that the connection unit have liquid feeding unit for feeding the liquid from the liquid container to the liquid ejecting head.

With this configuration, the liquid feeding unit can be replaced by the detachment of the connection unit alone. The liquid feeding units can be replaced simply.

Idea 8

It is preferable that the liquid ejecting apparatus according to any one of the Ideas 1 to 7 further include a transport path member for transporting the medium, at least a part of the transport path member is attachable/detachable to/from the liquid ejecting apparatus, and that the connection unit be exposed to the outside by a detachment of the transport path member.

With this configuration, since attachment/detachment of the connection unit is possible without the disassembly of the liquid ejecting apparatus, the repair or the replacement of the connection unit can be executed in a short time.

Idea 9

In the liquid ejecting apparatus according to Idea 8, it is preferable that the mounting portion has the movement path that extends toward the locking portion and that the side opposite to the movement path side of the connection unit be exposed to the outside by the detachment of the transport path member.

With this configuration, the connection unit can be attached/detachment by the work on the side opposite to the movement path side alone. Since the connection unit can be replaced simply, the repair or the replacement of the connection unit can be executed in a short time.

Idea 10

In the liquid ejecting apparatus according to any one of the ideas 1 to 7, it is preferable that a casing for accommodating the mounting portion, the liquid ejecting head, and a cover for covering at least a part of an opening provided in the casing and capable of opening/closing the opening be provided and that the connection unit be exposed to the outside by the opening of the cover and be attachable/detachable.

With this configuration, the attachment/detachment of the connection unit is possible without the disassembly of the liquid ejecting apparatus. As a result, the repair or the replacement of the connection unit can be executed in a short time.

The entire disclosure of Japanese Patent Application No. 2018-053975, filed Mar. 22, 2018 is expressly incorporated by reference herein.

What is claimed is:

1. A liquid ejecting apparatus comprising:

a mounting portion on which a liquid container accommodating a liquid is attachably/detachably mounted; and a liquid ejecting head configured to eject the liquid supplied through an outlet port of the liquid container onto a medium, wherein the mounting portion has a locking portion locking the liquid container and a connection unit connected to the outlet port of the liquid container, and the connection unit is attachable/detachable to/from the mounting portion in a state where the liquid container is attached to the mounting portion and locked by the locking portion and in a state where the liquid ejecting head is mounted on the liquid ejecting apparatus.

2. The liquid ejecting apparatus according to claim 1, wherein the mounting portion has a movement path that extends toward the locking portion, and the connection unit is attachable/detachable to/from the mounting portion from a side opposite to the movement path side where the movement path is provided.

3. The liquid ejecting apparatus according to claim 2, further comprising:

a transport path member that transports the medium, wherein at least a part of the transport path member is attachable/detachable to/from the liquid ejecting apparatus, and the connection unit is exposed to an outside by a detachment of at least a part of the transport path member.

4. The liquid ejecting apparatus according to claim 3, wherein the mounting portion has a movement path that extends toward the locking portion, and the side opposite to the movement path side of the connection unit is exposed to the outside by the detachment of at least a part of the transport path member.

5. The liquid ejecting apparatus according to claim 1, wherein the mounting portion has a movement path that extends toward the locking portion and a support member supporting and fixing the locking portion and the connection unit, and the locking portion is supported and fixed on the movement path side of the support member and the connection unit is supported and fixed on a side opposite to the movement path side of the support member.

6. The liquid ejecting apparatus according to claim 5, further comprising:

a transport path member that transports the medium, wherein at least a part of the transport path member is attachable/detachable to/from the liquid ejecting apparatus, and the connection unit is exposed to an outside by the detachment of at least a part of the transport path member.

7. The liquid ejecting apparatus according to claim 6, wherein the mounting portion has a movement path that extends toward the locking portion, and the side opposite to the movement path side of the connection unit is exposed to the outside by the detachment of at least a part of the transport path member.

8. The liquid ejecting apparatus according to claim 1, further comprising:

a supply flow path that communicates with the connection unit and the liquid ejecting head, wherein the mounting portion has a movement path that extends toward the locking portion, and one end of the supply flow path is attachable/detachable to/from the connection unit from a side opposite to the movement path side.

9. The liquid ejecting apparatus according to claim 1, wherein the mounting portion has a movement path that extends toward the locking portion, and the connection unit has a regulating portion that regulates movement of the liquid container in a direction intersecting with a direction in which the movement path extends.

10. The liquid ejecting apparatus according to claim 1, wherein the connection unit has a substrate connection portion that can be electrically connected to a circuit substrate provided in the liquid container.

11. The liquid ejecting apparatus according to claim 1, wherein the connection unit has a liquid feeding unit that feeds the liquid from the liquid container to the liquid ejecting head.

12. The liquid ejecting apparatus according to claim 1 comprising:

a casing that accommodates the mounting portion and the liquid ejecting head; and a cover that covers at least a part of an opening provided in the casing and that can be opened and closed, wherein the connection unit is exposed to the outside by the opening of the cover and is attachable/detachable.

13. The liquid ejecting apparatus according to claim 1 comprising:

a supply flow path provided between the connection unit and the liquid ejecting head, wherein the connection unit is attachable/detachable to/from an upstream end of the supply flow path.

14. The liquid ejecting apparatus according to claim 1 comprising:

wherein the connection unit is attachable/detachable to/from the mounting portion via a cavity defined in the mounting portion.

* * * * *